United States Patent [19]

Abe et al.

[11] Patent Number: 4,693,225

[45] Date of Patent: Sep. 15, 1987

[54] EXHAUST GAS RECIRCULATION SYSTEM FOR AUTOMATIC TRANSMISSION VEHICLE

[75] Inventors: Yoshio Abe; Tetsuo Okano; Tomohiro Omori; Minoru Kawamoto, all of Hiroshima, Japan

[73] Assignee: Mazda Motor Corporation, Japan

[21] Appl. No.: 835,109

[22] Filed: Feb. 28, 1986

[30] Foreign Application Priority Data

Mar. 6, 1985 [JP] Japan ..... 60-45096

[51] Int. Cl.[4] ..... F02M 25/06

[52] U.S. Cl. ..... 123/568; 74/860; 74/866

[58] Field of Search ..... 123/571, 568; 74/860, 74/866

[56] References Cited

U.S. PATENT DOCUMENTS

| | | | |
|---|---|---|---|
| 4,165,722 | 8/1979 | Aoyama | 74/860 |
| 4,208,929 | 6/1980 | Heino | 74/866 |
| 4,257,381 | 3/1981 | Yuzawa | 74/860 |
| 4,414,863 | 11/1983 | Heino | 74/866 |
| 4,467,673 | 8/1984 | Hamada | 74/860 |
| 4,486,838 | 12/1984 | Itoh et al. . | |
| 4,523,281 | 6/1985 | Noda | 74/866 |

FOREIGN PATENT DOCUMENTS

| | | | |
|---|---|---|---|
| 195056 | 11/1983 | Japan | 123/571 |
| 5854 | 1/1984 | Japan | 123/571 |

*Primary Examiner*—Douglas Hart

*Attorney, Agent, or Firm*—Gerald J. Ferguson, Jr.; Michael P. Hoffman; Ronni S. Malamud

[57] ABSTRACT

A vehicle is provided with an exhaust gas recirculation system and an automatic transmission which shifts in accordance with a plurality of shift patterns including a shift pattern in which upshift occurs at relatively low vehicle speeds and a shift pattern in which upshift occurs at relatively high vehicle speeds. The exhaust gas recirculation system includes an exhaust gas recirculation control mechanism which reduces the amount of exhaust gas to be returned to the combustion chamber when the former shift pattern is selected.

15 Claims, 7 Drawing Figures

FIG. 2 (II)
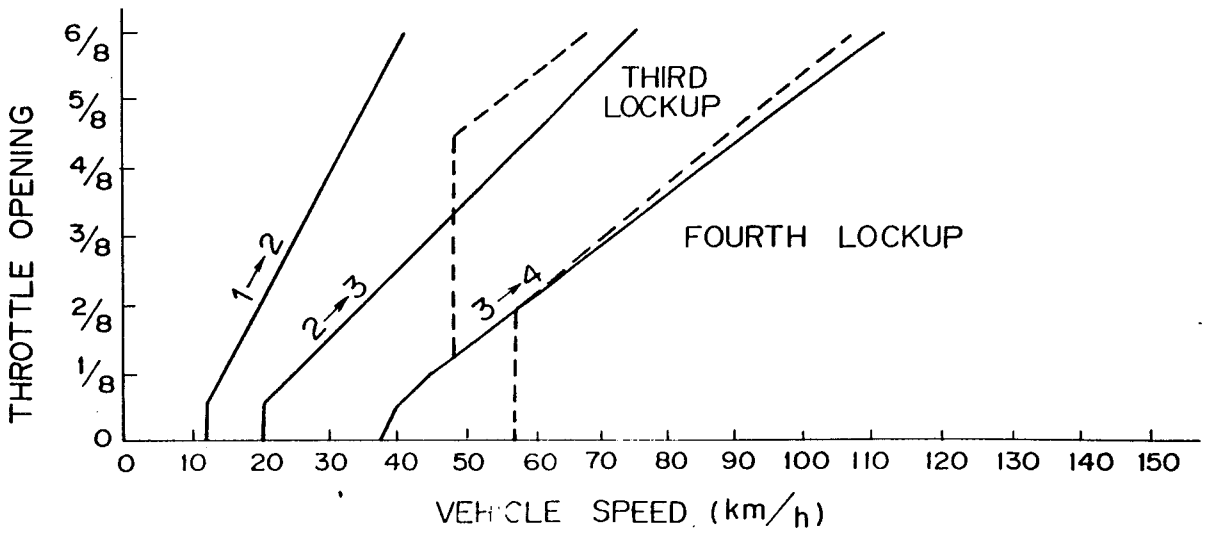

EXHAUST GAS RECIRCULATION SYSTEM FOR AUTOMATIC TRANSMISSION VEHICLE

BACKGROUND OF THE INVENTION

1. Field of the Invention

This invention relates to an exhaust gas recirculation system for an automatic transmission vehicle, and more particularly to an exhaust gas recirculation system for a vehicle provided with an automatic transmission having a plurality of shift patterns.

2. Description of the Prior Art

There has been in wide use an automatic transmission in which gear-shifting is automatically effected in accordance with a shift pattern predetermined according to the vehicle speed and the throttle opening. Recently, there has been put into practice an automatic transmission in which gear-shifting is automatically effected in accordance with a shift pattern chosen from a plurality of shift patterns by the driver. For example, when a shift pattern in which upshift occurs at relatively low vehicle speeds is selected, fuel economy can be improved since the engine runs mainly in relatively low rpm ranges. On the other hand, when a shift pattern in which upshift occurs at relatively high vehicle speeds is selected, the engine runs mainly in relatively high rpm ranges and, accordingly, a powerful driving force can be obtained.

However, when the vehicle having a plurality of shift patterns is provided with an exhaust gas recirculation system, there arises a problem that the operating condition of the engine is adversely affected by the exhaust gas returned to the combustion chamber when the shift pattern in which upshift occurs at relatively low vehicle speeds is selected. That is, in the exhaust gas recirculation system, a part of the exhaust gas, which is inert, is returned to the combustion chamber to lower the combustion temperature when the combustion temperature is high, thereby reducing formation of NOx. However, when the amount of exhaust gas returned to the combustion chamber is too large, the operating performance of the engine is adversely affected. Therefore, the amount of exhaust gas to be returned to the combustion chamber must be controlled according to the operating condition of the engine. However, conventionally the amount of exhaust gas to be returned to the combustion chamber has not been controlled in accordance with the rpm range to be mainly used, and accordingly, when the shift pattern in which a relatively low rpm range is mainly used is selected, the operating condition of the engine is deteriorated since the operating condition of the engine is more apt to be affected when the engine runs at low rpm.

SUMMARY OF THE INVENTION

In view of the foregoing observations and description, the primary object of the present invention is to provide an exhaust gas recirculation system for a vehicle provided with an automatic transmission which shifts in accordance with a plurality of shift patterns in which system the amount of exhaust gas to be returned to the combustion chamber is controlled so as not to adversely affect the operating performance of the engine when the shift pattern in which upshift occurs at relatively low vehicle speeds is selected.

In accordance with the present invention, a vehicle is provided with an exhaust gas recirculation system and an automatic transmission which shifts in accordance with a plurality of shift patterns including a shift pattern in which upshift occurs at relatively low vehicle speeds (which shift pattern will be referred to as "economy pattern", hereinbelow), and a shift pattern in which upshift occurs at relatively high vehicle speeds (which shift pattern will be referred to as "power pattern", hereinbelow). The exhaust gas recirculation system includes an exhaust gas recirculation control means which reduces the amount of exhaust gas to be returned to the combustion chamber when said economy pattern is selected. The exhaust gas recirculation system may reduce to zero the amount of exhaust gas returned to the combustion chamber or stop recirculation of exhaust gas, if necessary. For example, the exhaust gas recirculation system controls the negative pressure for driving a recirculation control valve of the exhaust gas recirculation system to reduce the amount of exhaust gas to be returned upon receipt of a signal indicating that the economy pattern is selected.

Since combustion temperature is low and formation of NOx is inherently little in the low engine rpm range, reduction of the amount of exhaust gas returned to the combustion chamber in the low engine rpm range does not increase NOx emission.

BRIEF DESCRIPTION OF THE INVENTION

FIG. 1 is a schematic view for illustrating an internal combustion engine provided with an exhaust gas recirculation system in accordance with an embodiment of the present invention, FIG. 2 shows an example of the power pattern and the economy pattern, FIG. 3 is an enlarged cross-sectional view of the EGR valve employed in the engine shown in FIG. 1, FIG. 4 is an enlarged cross-sectional view of the modulator valve employed in the engine, FIG. 5 is a flow chart for illustrating the operation of the control circuit employed in the engine, and FIG. 6 is a flow chart for illustrating the operation of the control circuit employed in the engine in accordance with a modification of the engine shown in FIG. 1.

DESCRIPTION OF THE PREFERRED EMBODIMENT

Figure 1:
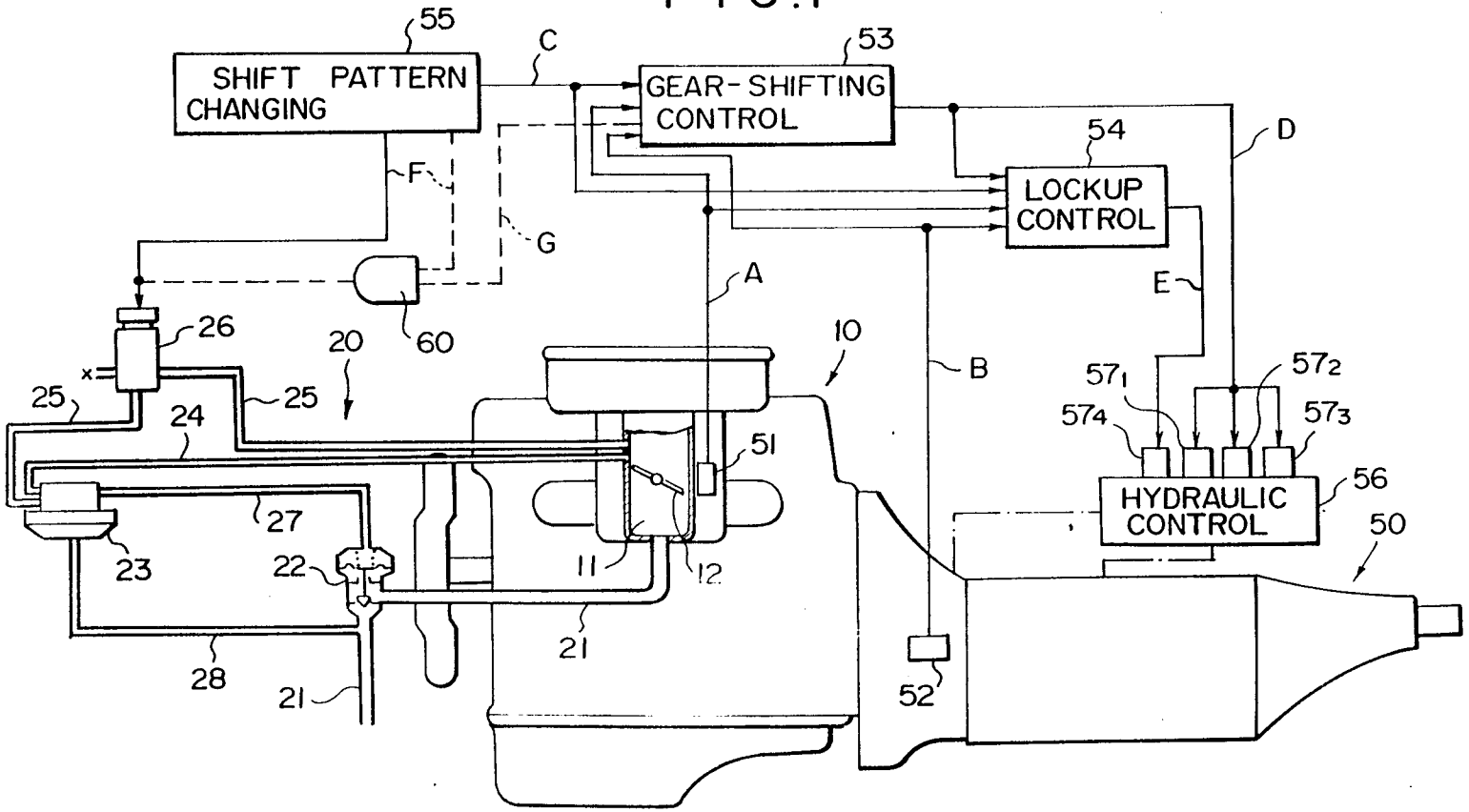

In FIG. 1, an internal combustion engine 10 is provided with an exhaust gas recirculation system 20 in accordance with an embodiment of the present invention and an automatic transmission 50 which shifts in accordance with a plurality of shift patterns.

The control system of the automatic transmission 50 includes a gear-shifting control circuit 53 and a lockup control circuit 54. A throttle opening signal A and a turbine rpm signal B are input to the gear-shifting control circuit 53 and the lockup control circuit 54 respectively from a throttle opening sensor 51 which detects the opening degree of the throttle valve 12 in the intake passage 11 of the engine 10 and a turbine rpm sensor 52 which detects the rotational speed of the output shaft of the torque convertor (turbine shaft) in the automatic transmission 50. The control system further includes a shift pattern changing device 55 which delivers a shift pattern signal C to the control circuits 53 and 54.

Figure 2:
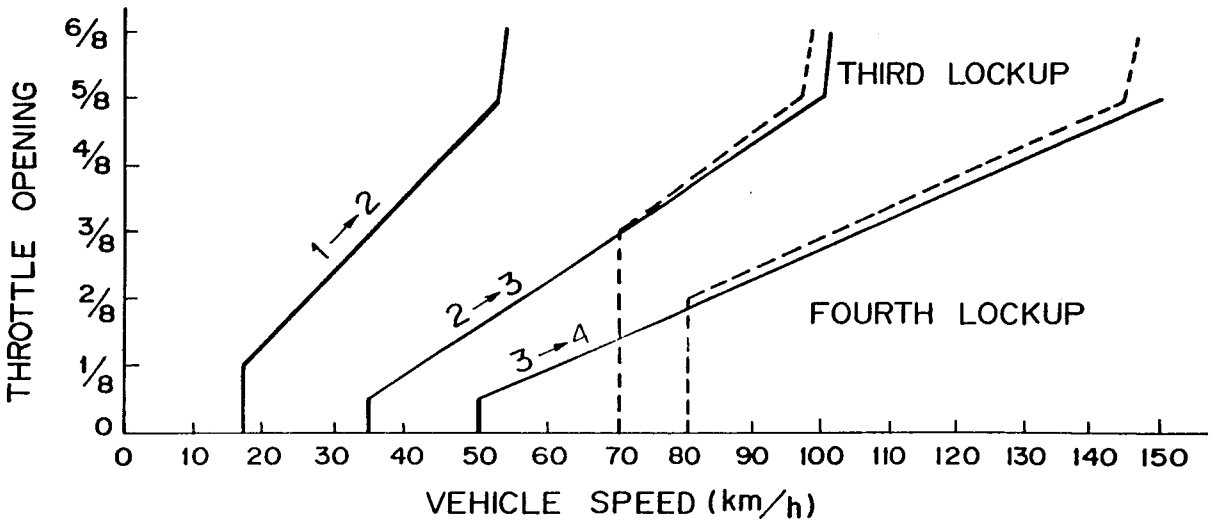

In this particular embodiment, the automatic transmission 50 shifts in accordance with a power pattern shown in FIG. 2-(I) or an economy pattern shown in FIG. 2-(II). As can be understood from FIG. 2, upshifts from first to second, from second to third and from third to fourth for a given throttle opening occur at lower speeds in accordance with the economy pattern than in accordance with the power pattern. At the same time, the lockup ranges for the third and the fourth in accordance with the economy pattern are lower than those in accordance with the power pattern. Thus, the engine 10 generally runs in a lower rpm range when the economy pattern is used than when the power pattern is used.

A hydraulic circuit 56 for the automatic transmission 50 includes first to fourth solenoids $57_1$ to $57_4$. The gear-shifting control circuit 53 delivers a gear-shifting control signal D to the first to third solenoids $57_1$ to $57_3$, and the lockup control circuit 54 delivers a lockup control signal E to the fourth solenoid $57_4$. That is, the automatic transmission 50 is shifted and the lockup clutch of the torque converter is engaged or disengaged according to the throttle opening and the turbine rpm (representing the vehicle speed) represented by the signals A and B and in accordance with the shift pattern selected by way of the shift pattern changing device 55.

The exhaust gas recirculation system 20 comprises an EGR (exhaust gas recirculation passage) 21 connecting the exhaust passage (not shown) with the intake passage 11 downstream of the throttle valve 12, an EGR (exhaust gas recirculation valve) 22 provided in the EGR passage 21 and a modulator valve 23 for controlling the negative pressure to be fed to the EGR valve 22. A first negative pressure introducing passage 24 directly communicates a portion of the intake passage immediately upstream of the throttle valve 12 with the modulator valve 23 so that negative pressure is introduced into the modulator valve 23 according to the throttle opening. A second negative pressure introducing passage 25 communicates a portion of the intake passage 11 immediately upstream of the throttle valve 12 with the modulator valve 23 by way of a three-way switching valve 26. The modulator valve 23 and the EGR valve 22 are communicated with each other by a control negative pressure feed passage 27, and an exhaust pressure introducing passage 28 communicates a portion of the EGR passage 21 immediately upstream of the EGR valve 22 with the modulator valve 23.

When the economy pattern is selected, the shift pattern changing device 55 delivers an economy pattern signal F to the three-way switching valve 26. The three-way switching valve 26 opens the second negative pressure introducing passage 25 to an atmosphere upon receipt of the economy pattern signal F.

Figure 3:
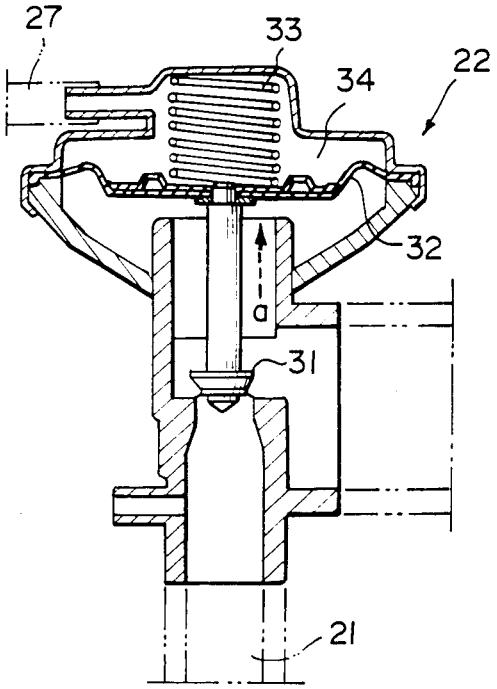

As shown in FIG. 3, the EGR valve 22 comprises a valve body 31 which is movable to open and close the EGR passage 21, a diaphragm 32 to which the valve body 31 is connected, and a spring 33 which urges the diaphragm 32 in the closing direction of the valve body 31. When a negative pressure is introduced into the negative pressure chamber 34 above the diaphragm 32 (as seen in FIG. 3) by way of the control negative pressure feed passage 27, the diaphragm 32 is displaced in the direction of the arrow a overcoming the spring 33 by an amount corresponding to the negative pressure introduced into the negative pressure chamber 34, whereby the opening degree of the EGR valve 22 is controlled.

Figure 4:
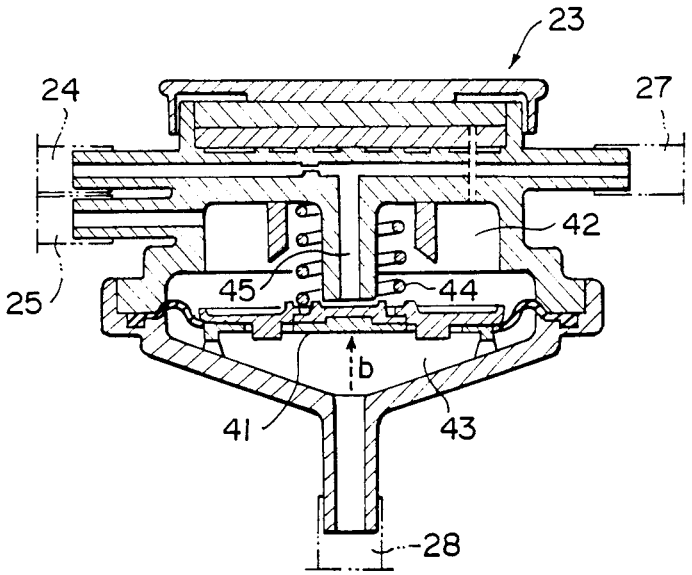

As shown in FIG. 4, the modulator valve 23 comprises a negative pressure chamber 42 and an exhaust pressure chamber 43 divided by a diaphragm 41. Said second negative pressure introducing passage 25 is connected to the negative pressure chamber 42 and said exhaust pressure introducing passage 28 is connected to the exhaust pressure chamber 43. A spring 44 for urging the diaphragm 41 toward the exhaust pressure chamber 43 is provided in the negative pressure chamber 42. Further, said first negative pressure introducing passage 24 is communicated with the control negative pressure feed passage 27 in the modulator valve 23, and a branch passage 45 branches off from the junction thereof. The free end of the branch passage 45 projects into the negative pressure chamber 42 and is opposed to the center of the diaphragm 41.

When negative pressure is introduced into the modulator valve 23 through the first negative pressure introducing passage 24 only (i.e., when the opening degree of the throttle valve 12 is relatively small), the negative pressure acts on the diaphragm 41 by way of the branch passage 45 and exhaust pressure acts on the diaphragm 41 by way of the exhaust pressure introducing passage 28, whereby the diaphragm 41 is displaced in the direction of the arrow b overcoming the force of the spring 44 to close the open end of the branch passage 45. Accordingly, the negative pressure in the first negative pressure introducing passage 24 is fed to the EGR valve 22 through the control negative pressure feed passage 27, thereby moving the valve body 31 to open the EGR passage 21 to permit recirculation of exhaust gas into the intake passage 11. When the EGR passage 21 is opened, the exhaust pressure introduced into the exhaust pressure chamber 43 of the modulator valve 23 through the exhaust pressure introducing passage 28 is lowered, and the diaphragm 41 is displaced in the direction opposite to the direction of the arrow b under the force spring 44, whereby the branch passage 45 is opened to relieve the negative pressure. Accordingly, the negative pressure introduced into the EGR valve 22 is lowered and the valve body 31 of the EGR valve 22 closes the EGR passage 21. The EGR valve 22 thus repeats opening and closure of the EGR passage 21 and exhaust gas is returned to the intake passage 11 through the EGR passage 21 according to the period of the opening and closure of the EGR passage 21. When the negative pressure is introduced into the modulator valve 23 through both the first and second negative pressure introducing passages 24 and 25 (i.e., when the opening degree of the throttle valve 12 is large), the diaphragm 41 is pressed against the open end of the branch passage 45 to completely close the branch passage 45 by the negative pressure introduced into the negative pressure chamber 42 through the second negative pressure introducing passage 25, and accordingly, the negative pressure in the first negative pressure introducing passage 24 is constantly fed to the EGR valve 22 through the control negative pressure feed passage 27, whereby the EGR valve 22 is held open and the amount of exhaust gas returned to the intake passage 21 is increased. That is, as the opening degree of the throttle valve 12 is increased and negative pressure comes to be introduced into the modulator valve 23 also through the second negative pressure introducing passage 25, the amount of exhaust gas returned to the intake passage 11 is increased.

Figure 5:
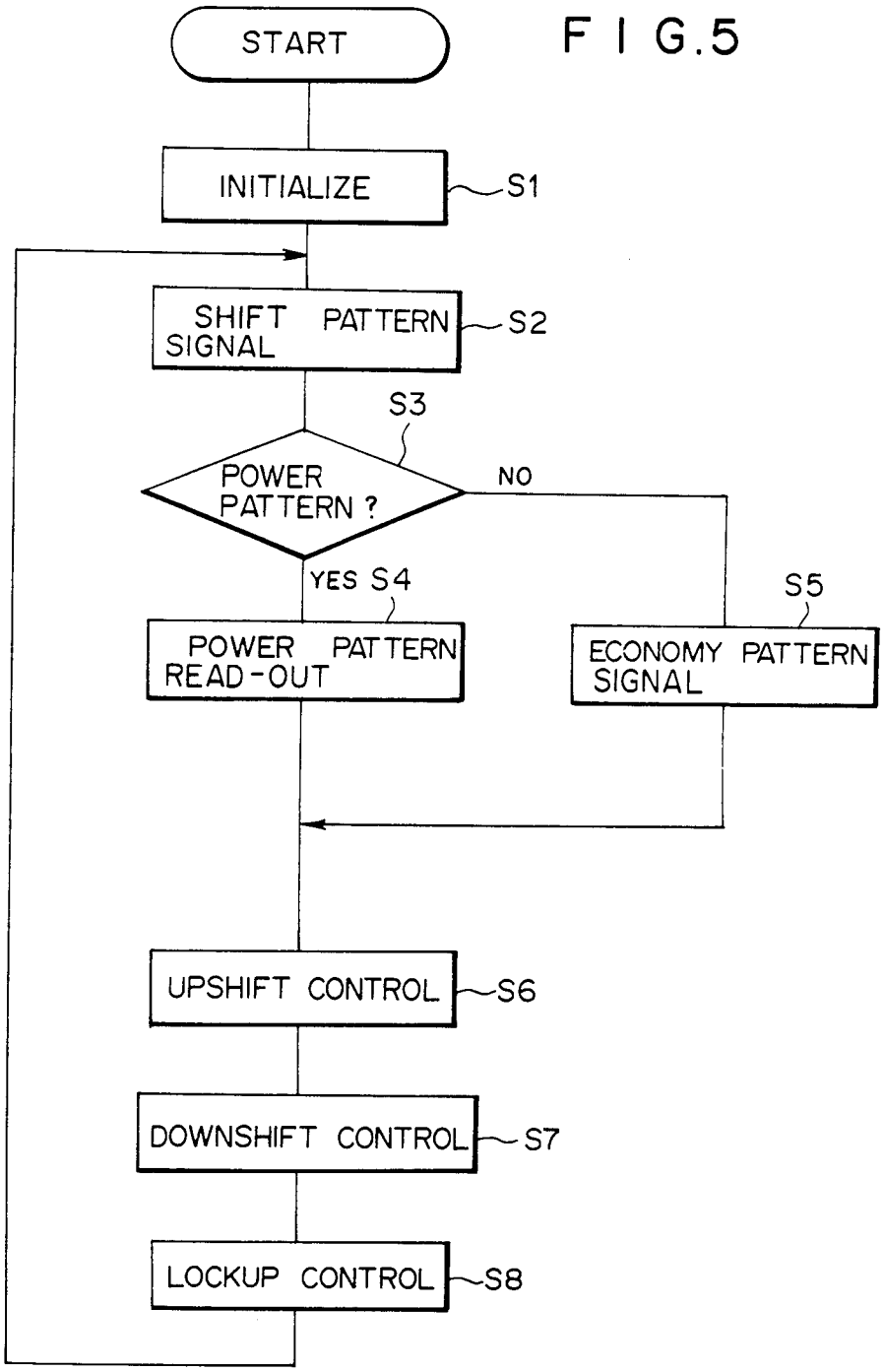

The relation between the shift pattern selected by way of the shift pattern changing device 55 and the amount of exhaust gas to be returned to the intake passage 11 will be described with reference to the flow chart shown in FIG. 5 which shows the operation of the gear-shifting control circuit 53 and the lockup control circuit 54. As shown in FIG. 5, the control circuits 53 and 54 determine which shifting pattern has been selected, the economy pattern or the power pattern. (Steps S2 and S3) When it is determined that the power pattern has been selected, a power pattern map such as one shown in FIG. 2-(I) is read and upshift control, downshift control and lockup control are effected in accordance with the power pattern. (Steps S4, S6, S7 and S8) When the power pattern is selected, the amount of exhaust gas to be returned to the intake passage 11 is increased with the increase in the throttle opening in the manner described above. On the other hand, when it is determined that the economy pattern has been selected, an economy pattern map such as one shown in FIG. 2-(II) is read and upshift control, downshift control and lockup control are effected in accordance with the economy pattern. (Steps S5, S6, S7, and S8) When the economy pattern is selected, the shift pattern changing device 55 delivers an economy pattern signal F to the three-way switching valve 26 as described above. The three-way switching valve 26 opens the second negative pressure introducing passage 25 to the atmosphere upon receipt of the economy pattern signal F. Accordingly, even when the opening degree of the throttle valve 12 is large, negative pressure cannot be introduced into the negative pressure chamber 42 of the modulator valve 23 through the second negative pressure introducing passage 25, and the EGR valve 22 repeats opening and closure of the EGR passage 21. Thus in the case where the economy pattern is selected, the amount of exhaust gas to be returned to the intake passage 11 is not increased with increase in the throttle opening.

Figure 6:
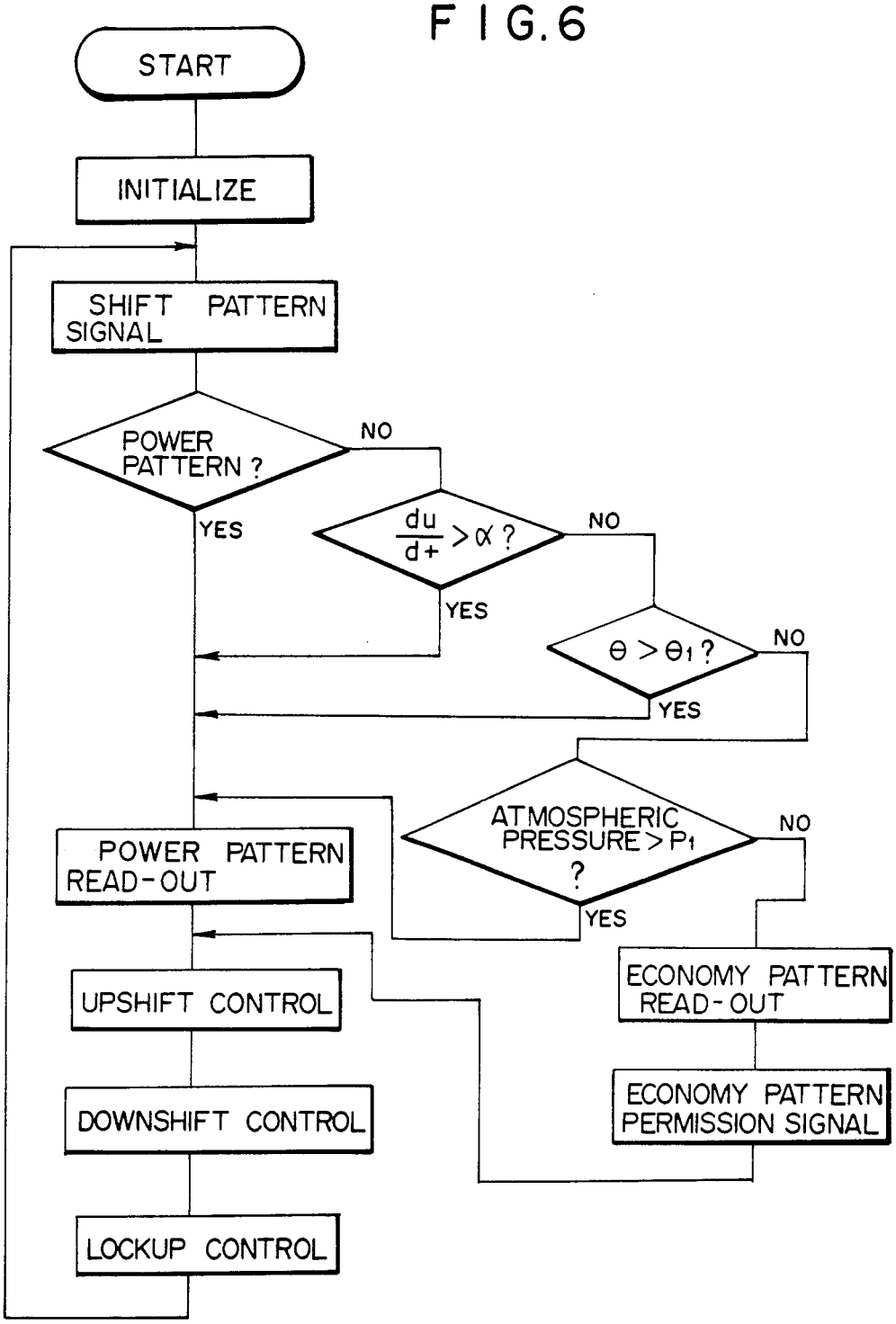

In the embodiment described above, when the economy pattern is selected by the shift pattern changing device 55, the shift pattern is locked to the economy pattern irrespective of the operating condition of the vehicle. In the embodiment shown in FIG. 6, even if the economy pattern is selected by the shift pattern changing device 55, the shift pattern is changed to the power pattern when the vehicle is accelerated and ascends or descends a slope. In this case, the economy pattern signal F is input into the three-way switching valve 26 from the shift pattern changing device 55 by way of a gate 60 as shown by a dotted line in FIG. 1 so that the economy pattern signal F is actually input into the three-way switching valve 26 only when an economy pattern permission signal G is generated from the gear-shifting control circuit 53. The operation of the control circuits 53 and 54 will be understood from the flow chart shown in FIG. 6.

What is claimed is:

1. An exhaust gas recirculation system for an internal combustion engine, comprising an automatic transmission which has a plurality of gear ratios and shifts between said gear ratios in accordance with a selected one of a plurality of shift patterns including an economy pattern in which upshift between successive ones of said plurality of gear ratios occurs at first corresponding predetermined vehicle speeds and a power pattern in which upshift between further successive ones of said plurality of gear ratios occurs at second corresponding predetermined vehicle speeds, wherein said second corresponding predetermined vehicle speeds are respectively greater than said first corresponding predetermined vehicle speeds, one of the shift patterns being selected by operation of a shift pattern changing means, and an exhaust gas recirculation control means which reduces the amount of exhaust gas to be returned to the combustion chamber for substantially all said vehicle speeds and loads in response to the selection of said economy pattern.

2. An exhaust gas recirculation system as defined in claim 1 in which said exhaust gas recirculation control means includes a recirculation control valve which is driven by a negative pressure to open and close the exhaust gas recirculation passage, and controls the negative pressure to be fed to the recirculation control valve to control the amount of exhaust gas to be returned.

3. An exhaust gas recirculation system as defined in claim 2 in which said recirculation control valve is fed with negative pressure by way of a modulator valve, and the exhaust gas recirculation control means controls the negative pressure to be fed to the recirculation control valve by controlling the modulator valve.

4. An exhaust gas recirculation system as defined in claim 3 in which said modulator valve is connected to a portion of the intake passage of the engine immediately upstream of the throttle valve by first and second negative pressure introducing passages, the first negative pressure introducing passage directly connecting the modulator valve with the portion of the intake passage, the second negative pressure introducing passage connecting the modulator valve with the portion of the intake passage by way of a three-way switching valve, and the exhaust gas recirculation control means controls the three-way switching valve to open the second negative pressure introducing passage to the atmosphere, when the economy pattern is selected, so that negative pressure is not fed to the modulator valve through the second negative pressure introducing passage.

5. An exhaust gas recirculation system as defined in claim 4 in which said modulator valve comprises a negative pressure chamber and an exhaust pressure chamber divided from each other by a diaphragm, the negative pressure chamber being adapted to be provided with a negative pressure by the second negative pressure introducing passage and the exhaust pressure chamber being adapted to be provided with the exhaust pressure by an exhaust pressure introducing passage, and said first negative pressure introducing passage is connected with a passage for feeding driving negative pressure to the recirculation control valve, a branch passage branching off from the junction thereof with the free end of the branch passage opposed to the diaphragm in said negative pressure chamber.

6. An exhaust gas recirculation system as defined in claim 1 in which said exhaust gas recirculation control means controls the amount of exhaust gas to be returned to the combustion chamber to be smaller when the economy pattern is selected than when the power pattern is selected in the operating range of the engine in which the engine load is heavier than a predetermined value.

7. An exhaust gas recirculation system as defined in claim 6 in which said exhaust gas recirculation control means increases the amount of exhaust gas to be returned in the operating range of the engine in which the engine load is heavier than the predetermined value when the power pattern is selected but does not increase the amount of exhaust gas to be returned in the same operating range of the engine when the economy pattern is selected.

8. An exhaust gas recirculation system for an internal combustion engine provided with an automatic transmission which shifts in accordance with a selected one of a plurality of shift patterns including an economy pattern in which upshift occurs at relatively low vehicle speeds and a power pattern in which upshift occurs at relatively high vehicle speeds, one of the shift patterns being selected by operation of a shift pattern changing means, the exhaust gas recirculation system being for returning a part of exhaust gas into the intake passage of the engine and comprising means for detecting the selected shift pattern, reduction determining means for determining, through the signal from the selected shift pattern detecting means, whether the amount of exhaust gas to be returned to the intake passage is to be reduced, and means for delivering a returning exhaust gas reduction signal to an adjustment means for controlling the amount of exhaust gas to be returned upon receipt of the signal from the reduction determining means, said reduction determining means determining whether the amount of exhaust gas to be returned to the intake passage is to be reduced so that a smaller amount of exhaust gas is returned for substantially all vehicle speeds and loads in response to the selection of the economy pattern rather than the power pattern.

9. An exhaust gas recirculation system as defined in claim 8 in which said automatic transmission is provided with a map in which said plurality of shift patterns are stored, a selection means for reading from the map the selected shift pattern according to the signal from the shift pattern changing means, a gear-shifting determination means which determines whether gear-shifting is to be effected in accordance with the selected shift pattern and the operating condition of the engine represented by engine load, vehicle speed and the like, and an actuator for changing the speed of the automatic transmission according to the signal from the gear-shifting determination means, and said reduction determining means makes said determination interrupting the steps for gear-shifting.

10. An exhaust gas recirculation system as defined in claim 9 in which said adjustment means includes a recirculation control valve which is driven by a negative pressure to open and close the exhaust gas recirculation passage, and controls the negative pressure to be fed to the recirculation control valve to control the amount of exhaust gas to be returned.

11. An exhaust gas recirculation system as defined in claim 10 in which said recirculation control valve is fed with the negative pressure by way of a modulator valve, and the adjustment means controls the negative pressure to be fed to the recirculation control valve by controlling the modulator valve.

12. An exhaust gas recirculation system as defined in claim 11 in which said modulator valve is connected to a portion of the intake passage of the engine immediately upstream of the throttle valve by first and second negative pressure introducing passages, the first negative pressure introducing passage directly connecting the modulator valve with the portion of the intake passage, the second negative pressure introducing passage connecting the modulator valve with the portion of the intake passage by way of a three-way switching valve, and the adjustment means controls the three-way switching valve to open the second negative pressure introducing passage to the atmosphere, when the economy pattern is selected, so that negative pressure is not fed to the modulator valve through the second negative pressure introducing passage.

13. An exhaust gas recirculation system as defined in claim 12 in which said modulator valve comprises a negative pressure chamber and an exhaust pressure chamber divided from each other by a diaphragm, the negative pressure chamber being adapted to be provided with a negative pressure by the second negative pressure introducing passage and the exhaust pressure chamber being adapted to be provided with the exhaust pressure by an exhaust pressure introducing passage, and said first negative pressure introducing passage is connected with a passage for feeding driving negative pressure to the recirculation control valve, a branch passage branching off from the junction thereof with the free end of the branch passage opposed to the diaphragm in said negative pressure chamber.

14. An exhaust gas recirculation system as defined in claim 8 in which said reduction determining means controls the amount of the exhaust gas to be returned to the combustion chamber to be smaller when the economy pattern is selected than when the power pattern is selected in the operating range of the engine in which the engine load is heavier than a predetermined value.

15. An exhaust gas recirculation system as defined in claim 14 in which said reduction determining means increases the amount of exhaust gas to be returned in the operating range of the engine in which the engine load is heavier than the predetermined value when the power pattern is selected but does not increase the amount of exhaust gas to be returned in the same operating range of the engine when the economy pattern is selected.

* * * * *